US005172480A

United States Patent [19]

Labuc et al.

[11] Patent Number: 5,172,480

[45] Date of Patent: Dec. 22, 1992

[54] BOREHOLE DEVIATION MONITOR

[75] Inventors: Vladimir M. Labuc, Hudson; Michel Hamelin, Pointe-Claire; David Sprott, Ile Bizard; Patrick Andrieux, Pierrefonds, all of Canada

[73] Assignee: Noranda Inc., Toronto, Canada

[21] Appl. No.: 755,499

[22] Filed: Aug. 28, 1991

[30] Foreign Application Priority Data

Aug. 31, 1990 [CA] Canada ..... 2024429

[51] Int. Cl.[5] ..... E21B 47/022

[52] U.S. Cl. ..... 33/304; 33/313; 324/346

[58] Field of Search ..... 33/304, 310, 313, 302, 33/356; 73/151; 324/346, 351

[56] References Cited

U.S. PATENT DOCUMENTS

| | | | |
|---|---|---|---|
| 4,452,075 | 6/1984 | Bockhorst et al. | 33/313 |
| 4,524,324 | 6/1985 | Dickinson | 33/304 |
| 4,649,349 | 3/1987 | Chiron et al. | 324/346 |
| 4,766,764 | 8/1988 | Trevillion | 73/151 |
| 4,813,274 | 3/1989 | DiPersio et al. | 33/313 |

FOREIGN PATENT DOCUMENTS

| | | | |
|---|---|---|---|
| 999735 | 11/1976 | Canada . | |
| 1196494 | 11/1985 | Canada . | |
| 197202 | 5/1966 | U.S.S.R. | 324/346 |
| 1467162 | 3/1989 | U.S.S.R. | 33/313 |
| 2122751 | 1/1984 | United Kingdom | 324/346 |
| 2229273 | 9/1990 | United Kingdom | 33/356 |

*Primary Examiner*—William A. Cuchlinski, Jr.
*Assistant Examiner*—Alvin Wirthlin
*Attorney, Agent, or Firm*—Keck, Mahin & Cate

[57] ABSTRACT

A borehole deviation monitor comprises a probe body adapted to be lowered in a borehole and including two inclinometers mounted in an orthogonal configuration to provide simultaneous X and Y axis inclination signals indicating the dip angle of the borehole with respect to the vertical and two triaxial magnetometers to provide reference signals indicating the azimuth angle of the borehole. The magnetometers are separated by a predetermined distance along the axis of the probe. A cable takeup winch mechanism is provided to lower the probe body into the borehole by predetermined increments equal to the distance between the two magnetometers. A control and data storage station is connected to the two inclinometers and magnetometers for reading and storing the data collected at each incremental distance and for correcting the azimuth reading given by the top magnetometer by substracting any difference in readings between the two magnetometers at the previous position of the probe.

6 Claims, 2 Drawing Sheets

BOREHOLE DEVIATION MONITOR

BOREHOLE DEVIATION MONITOR

BOREHOLE DEVIATION MONITOR

Figure 1:
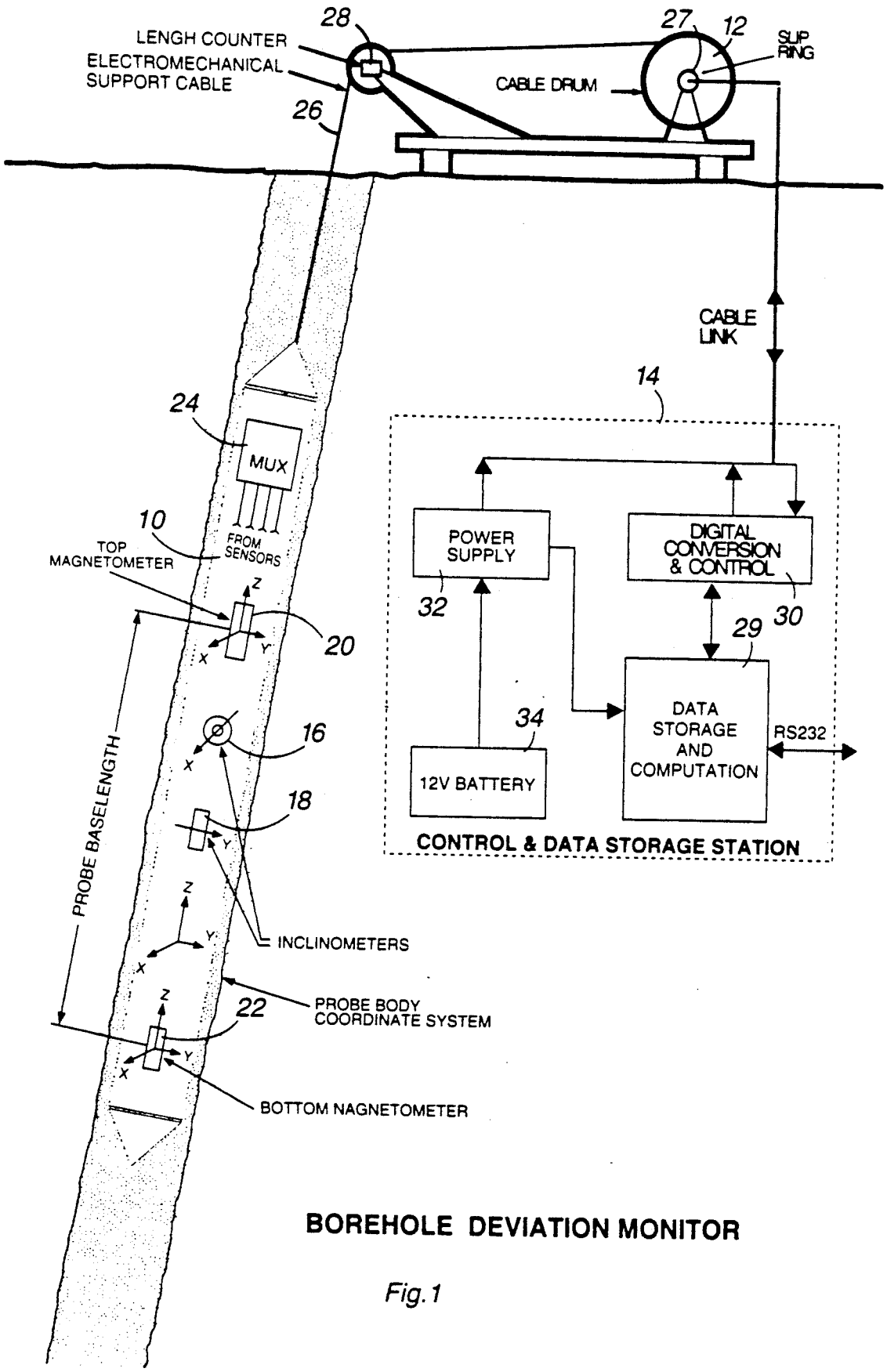

This invention relates to an instrument designed to measure and record, in three dimensional space, the trajectory of boreholes, among others, blasting and ore recovery operations both in surface and underground mines.

Blasting efficiency is largely determined by how closely actual drilled blastholes comply with designed blasting patterns Improperly located blastholes and subsequent loading with explosives can create severe problems with ore fragmentation, support pillars, hanging walls, backfill, ore dilution, and mucking. The invention described in the present application provides true hole path information by directly measuring dip and azimuth angles and computing X-Y deviations in terms of existing mine coordinates. The original blast design can then be modified and optimized according to the measured hole data.

Several types of borehole deviation instruments have been developed to-date and can be classified into the following categories:

1. Instruments which measure only the relevant dip angle by various methods including solidifying waxes and gelatins, acid etching agents in cylindrical containers, and mechanical methods which serve to immobilize pendulum assemblies inside the probe at known test depths. These types of sensors do not measure azimuth changes and therefore do not measure actual hole path.

2. Instruments that use optical methods to determine hole direction. Examples of these include the "Light Log" (Techdel International Inc.), the "ABEM Reflex-Fotobor" (Atlas Copco), and various probes developed by Humphrey Inc. These instruments record data on photographic film and require time consuming analysis to generate usable deviation information.

3. Instruments that use torsionally rigid suspension assemblies to prevent probe rotation during measurement. This design typically uses two orthogonal inclinometers to calculate X and Y deviations in the horizontal plane. No other sensors are needed since the reference coordinates are established at the beginning of the test and maintained mechanically for the duration of probe travel. One known instrument of this type is the "BORETRAK" (Measurement Devices Limited) which uses fiberglas or carbon fiber rods interlocked at 6 ft intervals with mechnical elbow joints. Although simple in principle, in practical applications this system has been prone to rod breakage which is time consuming and expensive to repair. The accuracy of the measurement is directly dependent on the torsional integrity of each elbow joint. A typical borehole of 150 ft length needs 25 individual rod sections to reach bottom.

4. Instruments that use electronic or electromechanical sensors to generate a stable reference coordinate system based on inertia, gravity, or the earth's magnetic field. Four examples have been selected as representative of typical design principles:

a) Canadian patent No. 1,196,494 describes a probe which uses a well known orthogonal inclinometer technique to determine X-Y deviations and which incorporates an optical method to calculate and compensate for probe rotation. A beam of polarized light is sent up to the measurement console via a fiber optic cable. Changes in light intensity as the probe rotates in relation to a polarization analyzer at the control end are translated to degrees of probe rotation by an algorithm disclosed in the patent. Fiber optic cable of the quality needed for this type of application is both fragile and expensive and the need for an optical detection system is a significant design complication.

b) Canadian patent No. 999,735 basically describes a probe which uses inclinometers to determine the dip angle and rate sensing gyroscopes to calculate the azimuth reference. This system has the advantage of being able to log very deep holes of the type used in oil exploration. The complexity and cost of the head components together with the fragility of the gyroscope system makes this and similar instruments unsuitable for general purpose measurements of relatively shallow (<200 ft) holes.

c) An existing commercially available system sold by Owl Technical Associates Inc. which uses the earth's magnetic field as the azimuth reference. Standard inclinometers are used to determine X-Y deviations. The magnetic reference is sensed by a biaxial magnetometer hung on a pendulum to maintain necessary horizontal orientation. This type of probe needs to have a constant unidirectional reference field to function. Magnetic surroundings cause ambiguities in the magnetometer readings leading to measurement errors.

d) A complete line of commercial borehole surveying systems manufactured by Humphrey Inc. The various models are all versions of the systems described above and can be purchased using magnetic or gyroscopic referencing options. The gyro option is recommended by the manufacturer when magnetic field conditions prevent the use of the north seeking system.

It is the object of the present invention to provide a borehole deviation monitor which use the earth's magnetic field as a measurement reference in spite of the presence of magnetic ores. The instrument does not use any devices other than magnetometers to measure azimuth angles. The probe is also lowered in the borehole using a regular cable and is free to rotate.

It is also an object of the present invention to provide an instrument which use a triaxial magnetometer to measure azimuth angles instead of the usual biaxial magnetometer which requires some means to maintain the necessary horizontal orientation.

The borehole deviation monitor in accordance with the present invention comprises a probe body adapted to be lowered in a borehole and including two inclinometers mounted in an orthogonal configuration to provide simultaneous X and Y axis inclination signals indicating the dip angle of the borehole with respect to the vertical and two triaxial magnetometers to provide reference signals indicating the azimuth angle of the borehole, such magnetometers being separated by a predetermined distance along the axis of the probe, a cable takeup winch mechanism to lower the probe into the borehole by increments equal to the distance between the two magnetometers, and a control and data storage station connected to the inclinometers and magnetometers for reading and storing the data collected at each incremental distance and for correcting the azimuth reading given by the top magnetometer by substracting any difference in readings between the two magnetometers at the previous position of the probe.

A signal multiplexer is preferably mounted on the probe for conveying the signals from the inclinometers and magnetometers to the control and data storage station over an electromechanical cable which is used to lower the probe. The winch mechanism is provided with slip rings to transfer the signals from the signal multiplexer to the control and data storage station over a cable link.

A length counter is incorporated into the winch mechanism to provide the downhole distance information to the control and data storage station.

The control and data storage station includes an analog to digital converter for converting the analog signals of the inclinometers and magnetometers into the digital form.

Figure 2:
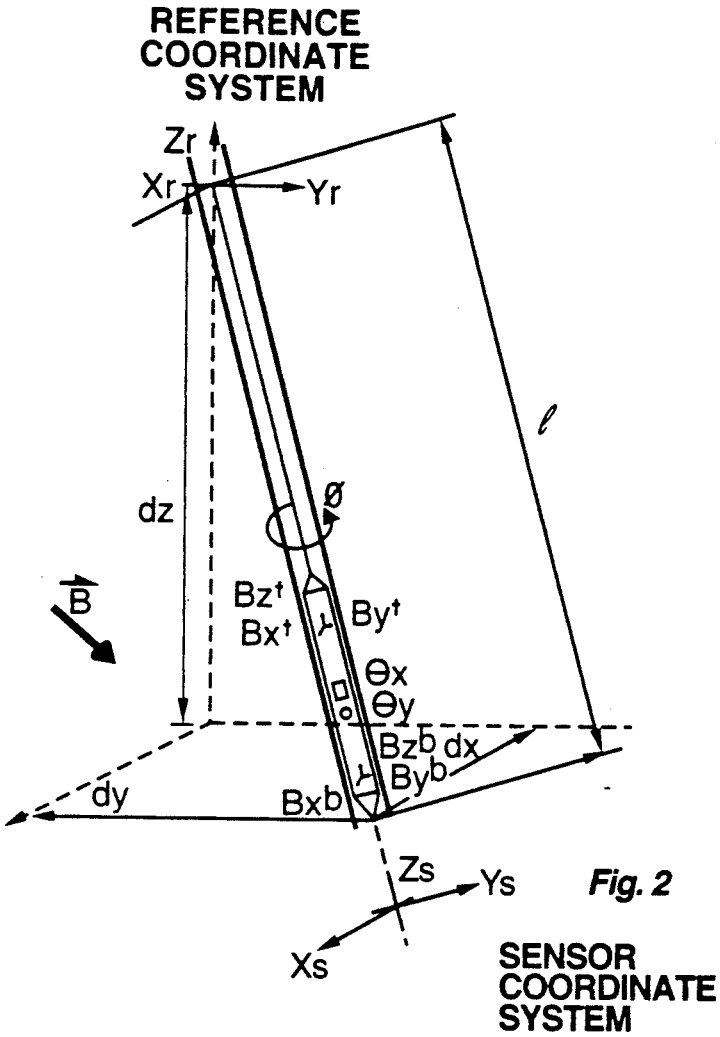
Figure 3:
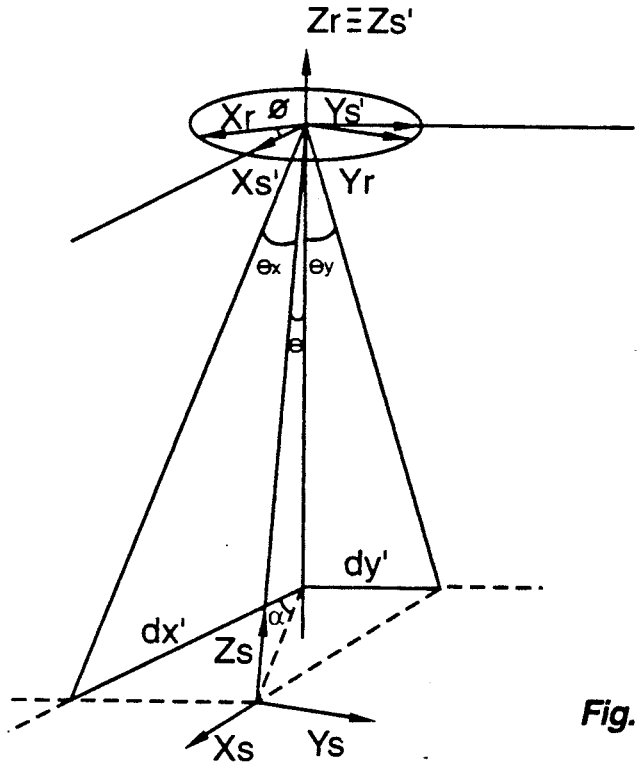

The invention will now be disclosed, by way of example, with reference to a preferred embodiment in which:

FIG. 1 is a block diagram of the probe and control electronics of the borehole deviation monitor in accordance with the invention; and FIGS. 2 and 3 are vector diagrams illustrating the mathematical processing of the data derived from the inclinometers and magnetometers of the probe.

Referring to the block diagram shown in FIG. 1, the main components of the measuring system are the probe body 10, the cable takeup winch mechanism 12, and the control and data storage station 14.

Hole trajectory data is derived from two single axis inclinometers 16 and 18 and two triaxial magnetometers 20 and 22. The two inclinometers are mounted in an orthogonal configuration to provide simultaneous X and Y axis inclination signals with respect to the vertical. Two sensors are required because the probe body is free to rotate about its own axis when being lowered down the borehole. A single inclinometer could be used but would require the extra complication of a mechanical pendulum assembly to provide a constant vertical reference axis. The two axis design enhances system reliability by allowing rigid mounting of the sensors without mechanical linkages. The actual dip angle, which is the inclination of the borehole referenced to gravity, is calculated from data derived from both sensors. The inclinometers are standard off the shelf components.

Knowledge of the absolute dip angle is insufficient to calculate the path of the borehole because for each dip angle there are an infinite number of directions that the hole can point around a 360 degree cone of rotation. To determine this angle of heading, known as the azimuth angle, a second reference coordinate system is required. In the case of the present invention the magnetic field of the earth was chosen to calculate azimuth heading.

A known technique to determine azimuth is to use a two axis magnetometer mounted on a freely swinging gimbal arrangement to maintain a constant horizontal orientation independent of probe dip angle. The system behaves like an electronic compass with the signals from the two X and Y axes processed via standard mathematical methods to yield azimuth direction.

The borehole deviation monitor in accordance with the present invention uses fluxgate magnetometers to calculate azimuth heading but, unlike other designs, eliminates the need for a mechanical horizontal reference by incorporating an additional magnetometer channel aligned with the Z axis of the probe. This feature allows rigid mounting of the compass assembly with azimuth calculations based on three axis data instead of two.

During a typical measurement, the winch 12 is used to lower the probe body into the borehole with readings taken at convenient increments e.g. every 5 to 10 ft. Referring to FIG. 1, signals from the inclinometers and magnetometers are conveyed, via a signal multiplexer 24 and an electromechanical support cable 26 to the control and data storage station 14. Slip rings 27 are used to transfer sensor signals across the rotating takeup drum in the winch. A length counter 28 incorporated into the cable guide pulley provides the necessary downhole distance information. The data control and storage include a small computer 29 which performs data storage and computation. The analog signals originating from the inclinometers and magnetometers are converted to digital form by an analog to digital converter 30 prior to being fed to the computer. The data control and storage station also include a power supply 32 powered by a battery 34. Power and control signals from the data control and data storage station are also fed to the probe through slip rings 27. At each measurement interval, the small computer sequences the multiplexer, reads the two inclinometers and the two triaxial magnetometer signals, and stores the data for subsequent processing. The probe is then lowered to the next measurement point and the process is repeated over the entire length of the borehole. Inclinometer and magnetometer data is subsequently converted by processing software into hole deviation data suitable for analysis and plotting. The above discussion, implying that dip information is derived from the inclinometers and that the magnetometer compass supplies the azimuth heading is correct in the final analysis, but the actual computation involves a relatively complex interaction of the data from the two sensors and is described later.

The system described up to now is similar, with the exception of the use of two triaxial magnetometers to instruments currently available e.g. "Owl Technical Associates model 780". All existing instruments using a single magnetometer reference system, however, specify operation only in regions of constant magnetic field. Variations in field direction due to magnetic orebodies render these systems inoperative and resort must be made to gyroscopic references to replace the compass section. It is an object of the present invention to provide a magnetometer based probe capable of operating in varying magnetic field environments. As shown in FIG. 1, a second triaxial magnetometer 22, identical to the first magnetometer 20, is located in the bottom section of the probe body. The distance between the two units is fixed and determines the "probe baselength". At any measurement position down the hole the top magnetometer indicates the direction of the reference field at its own elevation and the bottom unit performs the same function but displaced one probe baselength lower in the hole. In areas of constant field the two magnetometers read the same values. In regions of varying field direction a difference in readings will be apparent. This difference represents the twist in the reference field between the two magnetometer locations. The difference in readings is measured and stored and the probe is lowered so that the top magnetometer now occupies the same position as the bottom magnetometer in the previous reading. The apparent azimuth reading given by the top sensor is corrected by subtracting the difference in readings at the previous position. As long as the measurements are taken in increments of the probe baselength the differential magnetometer concept corrects for reference field variations along the length of the borehole. An additional feature of this compensation method, potentially useful in some applications, is the ability to obtain a plot of the magnetic field direction and strength in the rock mass adjacent to the borehole.

The mathematical processing of the data derived from the inclinometers and magnetometers is based on the following:

The borehole deviation monitor probe consists of two electronic inclinometers and two triaxial magnetometers. These sensors are positioned in the following configuration: the sensitive planes of the inclinometers are perpendicular, and the magnetometers are placed such that one of their sensitive axis is parallel to the probe walls while the other two axes are aligned with the inclinometers sensitive planes. The magnetometers are placed near the ends of the probe.

Supposing that the probe is following a reasonably smooth trajectory, the problem is to derive its position in cartesian coordinate at various distance increments along the trajectory. In order to do this calculation, the dip angle is first obtained from the inclinometers reading. The dip angle is then used to compute the projection of the magnetic field vector in the horizontal plane, which will provide an orientation reference needed to compensate for the rotation of the probe on its axis. From the dip angle, the increment distance and the orientation reference, it is possible to calculate the displacement of the probe in cartesian coordinates.

As shown in FIG. 2, a fixed reference cartesian coordinate system is defined by the unitary vectors $[x_R, y_R, z_R]$, and a second coordinate system by the unitary vectors $[x_S, y_S, z_S]$parallel to the sensors, sensitive axes. The latter will be called the sensor coordinate system in the rest of this text. For one distance increment approximated by a straight line, the probe's position is given by the vector $(d_x, d_y, d_z)$ representing the orthogonal components of the displacement in the reference system. The data provided by the sensors are as follows :

$\theta_x$, $\theta_y$: inclination angles along the $x_S$ and $y_S$ directions.

$B_x^t$, $B_y^t$, $B_z^t$: magnetic field vector components along the sensitive axes of the top magnetometer.

$B_x^b$, $B_y^b$, $B_z^b$: magnetic field vector components along the sensitive axes of the bottom magnetometers.

l: distance increment.

In order to plot the trajectory of the probe with respect to the reference coordinate, one also needs to know the angle $\beta$ between the magnetic field and the reference coordinates at the beginning of the trajectory.

Let $[x_S', y_S', z_S']$ be the sensor coordinate system after being rotated through the dip angle $\theta$ in order to have the $z_S'$ axis parallel to the $z_R$ axis (see FIG. 3).

Then, the projections of l along the $x_S'$, $Y_S'$ and $z_S'$ directions are :

$$d_x' = \frac{l\sin\theta_x\cos\theta_y}{(1-\sin^2\theta_x\sin^2\theta_y)^{\frac{1}{2}}}$$

$$d_y' = \frac{l\sin\theta_y\cos\theta_x}{(1-\sin^2\theta_x\sin^2\theta_y)^{\frac{1}{2}}}$$

$$d_z' = \frac{d_x'}{\tan\theta_x} = \frac{d_y'}{\tan\theta_y}$$

The vector $(d_x', d_y', d_z')$ in the reference system represents the position of the sensor before compensating for the rotation of the probe through an angle $\theta$ about the $z_S$ direction.

The sensor coordinate system $[x_S, y_S, z_S]$ can be transformed in the system $[x_S', y_S', z_S']$ by three rotations : a first rotation through an angle $\alpha$ about the $z_S$ direction to bring the $y_S$ axis in the $[x_R, y_R]$ plane, then a rotation through the angle $\theta$ about the new $y_R$ direction and finally a rotation through the angle $-\alpha$ about the new $z_S$ direction. The angle between the $x_S'$ axis and the $x_R$ axis is then the angle $\phi$ expressed in the horizontal plane. This angle will be used to compensate for the rotation of the sensor head on its axis. The compensation angles calculated from the top and bottom magnetometers data will be noted $\phi_t$ and $\phi_b$ respectively.

The $\alpha$ and $\theta$ angles are given by the relations :

$$\alpha = \tan^{-1}(d_y/d_x)$$

$$\theta = \tan^{-1}\left[\frac{(d_x^2 + d_y^2)^{\frac{1}{2}}}{d_z}\right]$$

Since the magnetic field is used for orientation reference, the rotations are performed on the vectors $(B_x^t{}_S, B_y^t{}_S, B_z^t{}_S)$ ,and , $(B_x^b{}_S, B_y^b{}_S, B_z^b{}_S)$,where the subscript S stands for the sensor coordinate system. Using the Euler angles method, we thus have :

$$\begin{bmatrix} B_x^t{}_R \\ B_y^t{}_R \\ B_z^t{}_R \end{bmatrix} = \begin{bmatrix} \cos^2\alpha\cos\theta + \sin^2\alpha & \cos\alpha\cos\theta\sin\alpha - \sin\alpha\cos\alpha & -\cos\alpha\sin\theta \\ \sin\alpha\cos\theta\cos\alpha - \cos\alpha\sin\alpha & \sin^2\alpha\cos\theta + \cos^2\alpha & -\sin\alpha\sin\theta \\ \sin\theta\cos\alpha & \sin\theta\sin\alpha & \cos\theta \end{bmatrix} \begin{bmatrix} B_x^t{}_S \\ B_y^t{}_S \\ B_z^t{}_S \end{bmatrix}$$

We can now calculate $\phi_t$:

$$\phi_t = \tan^{-1}(B_y^t{}_R/B_x^t{}_R)$$

$$\phi_t = \tan^{-1}\left[\frac{B_x^t{}_S(\sin\alpha\cos\theta\cos\alpha - \cos\alpha\sin\alpha) + B_y^t{}_S(\sin^2\alpha\cos\theta + \cos^2\alpha) - B_z^t{}_S(\sin\alpha\sin\theta)}{B_x^t{}_S(\cos^2\alpha\cos\theta + \sin^2\alpha) + B_y^t{}_S(\cos\alpha\cos\theta\sin\alpha - \sin\alpha\cos\alpha) - B_z^t S(\cos\alpha\sin\theta)}\right]$$

The position in the reference system is therefore :

$$\begin{bmatrix} d_x \\ d_y \\ d_z \end{bmatrix} = \begin{bmatrix} \cos(\phi-\beta) & \sin(\phi-\beta) & 0 \\ -\sin(\phi-\beta) & \cos(\phi-\beta) & 0 \\ 0 & 0 & 1 \end{bmatrix} \begin{bmatrix} d_x' \\ d_y' \\ d_z' \end{bmatrix}$$

By summing this position variation for many distance increments, a trajectory of the sensor can be plotted.

In a varying magnetic field, the orientation reference from a single triaxial magnetometer cannot be used. In this case, the signals from two triaxial magnetometers separated by the distance increment l can provide the orientation reference. $\phi_t^i$ and $\phi_b^i$ be the orientation angles provided by the two magnetometers for the $i^{th}$ measurement, and suppose that for the $i+1^{th}$ measurement, the top magnetometer occupies the position of the bottom magnetometer during the $i^{th}$ measurement.

The position variation in the reference coordinate system for the $i+1^{th}$ measurement is then :

$$\begin{bmatrix} d_x^i \\ d_y^i \\ d_z^i \end{bmatrix} = \begin{bmatrix} \cos(\phi_t^{i+1} + (\phi_b^i - \phi_t^i) - \beta) & \sin(\phi_t^{i+1} + (\phi_b^i - \phi_t^i) - \beta) & 0 \\ -\sin(\phi_t^{i+1} + (\phi_b^i - \phi_t^i) - \beta) & \cos(\phi_t^{i+1} + (\phi_b^i - \phi_t^i) - \beta) & 0 \\ 0 & 0 & 1 \end{bmatrix} \begin{bmatrix} d_x^{i'} \\ d_y^{i'} \\ d_z^{i'} \end{bmatrix}$$

Again, the summation of these deviation vectors will provide the trajectory of the sensor head.

Although the invention has been disclosed with reference to a preferred embodiment, it is to be understood that it not limited to such embodiment and that other alternatives are also envisaged within the scope of the following claims.

We claim:

1. A borehole deviation monitor comprising:

a) a probe body adapted to be lowered in a borehole and including two inclinometers mounted in an orthogonal configuration to provide simultaneous X and Y axis inclination signals indicating the dip angle of the borehole with respect to the vertical and two triaxial magnetometers to provide reference signals indicating the azimuth angle of the borehole, said magnetometers being separated by a predetermined distance along the axis of the probe;

b) a cable takeup winch mechanism including means to lower the probe body into the borehole by successive incremental distances equal to the distance between the two magnetometers; and c) a control and data storage station connected to the two inclinometers and magnetometers for reading and storing the data collected at each incremental position of the probe and including means for correcting the azimuth reading given by the top magnetometer at any given position of the probe by subtracting therefrom any difference in readings between the two magnetometers at the previous position of the probe.

2. A borehole deviation monitor as defined in claim 1, further comprising a signal multiplexer mounted on the probe body for conveying the signals from the inclinometers and magnetometers to the control and data storage station over an electromechanical cable which is used to lower the probe.

3. A borehole deviation monitor as defined in claim 2, wherein the winch mechanism is provided with slip rings permitting to transfer the signals from the signal multiplexer to the control and data storage station over a cable link.

4. A borehole deviation monitor as defined in claim 3, wherein a length counter is incorporated into the winch mechanism to provide the downhole distance information to the control and data storage station.

5. A borehole deviation monitor as defined in claim 1, wherein the control and data storage station includes an analog to digital converter for converting the analog signals of the inclinometers and magnetometers into digital form.

6. A method of monitoring borehole deviation using a probe body adapted to be lowered in a borehole and including two inclinometers mounted in an orthogonal configuration to provide simultaneous X and Y axis inclination signals indicating the dip angle of the borehole with respect to the vertical and two triaxial magnetometers to provide reference signals indicating the azimuth angle of the borehole, said magnetometers being separated by a predetermined distance along the axis of the probe, said method comprising:

a) lowering the probe body into the borehole by successive incremental distances equal to the distance between the two magnetometers;

b) reading and storing the data collected by the two magnetometers at each incremental position of the probe; and c) correcting the azimuth reading given by the top magnetometer at any given position of the probe by subtracting therefrom any difference in readings between the two magnetometers at the previous position of the probe.

* * * * *